US005244041A

United States Patent [19]

Renard et al.

[11] Patent Number: 5,244,041

[45] Date of Patent: Sep. 14, 1993

[54] METHOD FOR STIMULATING AN EFFLUENT-PRODUCING ZONE ADJOINING AN AQUIFER BY LATERAL SWEEPING WITH A DISPLACEMENT FLUID

[75] Inventors: Gerard Renard; Claude Gadelle, both of Rueil-Malmaison, France

[73] Assignee: Institut Francais du Petrole, Rueil-Malmaison, France

[21] Appl. No.: 873,778

[22] Filed: Apr. 27, 1992

[30] Foreign Application Priority Data

Apr. 26, 1991 [FR] France ..... 91 05283

[51] Int. Cl.[5] ..... E21B 43/20; E21B 43/22; E21B 43/24; E21B 43/30

[52] U.S. Cl. ..... 166/268; 166/50; 166/52; 166/269; 166/272

[58] Field of Search ..... 166/50, 272, 268, 245, 166/369, 370, 303

[56] References Cited

U.S. PATENT DOCUMENTS

| | | | |
|---|---|---|---|
| 2,885,003 | 5/1959 | Lindauer, Jr. | 166/268 |
| 4,344,485 | 8/1982 | Butler | 166/271 |
| 4,574,884 | 3/1986 | Schmidt | 166/263 |
| 4,598,770 | 7/1986 | Shu | 166/245 |
| 4,705,431 | 11/1987 | Gadelle et al. | 405/267 |
| 4,785,886 | 11/1988 | Renard | 166/370 |
| 4,832,122 | 5/1989 | Corey et al. | 166/50 |
| 5,002,127 | 3/1991 | Dalrymple et al. | 166/295 |

FOREIGN PATENT DOCUMENTS 3300686 7/1984 Fed. Rep. of Germany .

*Primary Examiner*—Stephen J. Novosad

*Attorney, Agent, or Firm*—Antonelli, Terry, Stout & Kraus

[57] ABSTRACT

In a petroliferous zone surmounting an aquifer, a lateral sweep stimulation is achieved by means of a fluid capable of displacing the petroleum effluents (a warm fluid such as steam, a solvent, etc), which is injected into the formation through a deflected injection drain, i.e. a first drain, horizontal for example), and the oil displaced by the displacement fluid is withdrawn through a withdrawing drain, i.e. a second drain, laterally offset in relation to the first drain and substantially parallel to it. In order to prevent the oil from being displaced into the aquifer and remaining trapped therein, a third drain and possibly a fourth drain closer to the interface (I) with the aquifer than the first and the second drain are bored into the petroliferous zone. A water circulation (injection and/or withdrawal) established by means of the third drain and/or of the fourth drain considerably limits the trapping of the displacement fluid and of the displaced oil by diverting the displacement lines of the fluidized effluents towards the second drain.

11 Claims, 2 Drawing Sheets

METHOD FOR STIMULATING AN EFFLUENT-PRODUCING ZONE ADJOINING AN AQUIFER BY LATERAL SWEEPING WITH A DISPLACEMENT FLUID

BACKGROUND OF THE INVENTION

The invention relates to a method for stimulating the production of an underground zone containing petroleum effluents and adjoining an aquifer, by lateral sweeping by means of a fluid capable of displacing the effluents, such as a warm fluid, a solvent, etc.

The method according to the invention particularly applies to the stimulation of the production, through a deflected drain, of a zone where displacing dense petroleum effluents is obtained by injecting into the formation a displacement fluid by means of another deflected drain.

What is called a deflected drain is any drain whose part running across the producing formation is horizontal or at least very inclined in relation to the vertical.

It is well-known that, in reservoirs where a horizontal boundary or interface initially exists between a producing zone and an aquifer under pressure, the interface undergoes a deformation at the time of a withdrawal through a well close to the interface (coning or edge effect). If the dynamic depression resulting from the flow is sufficient, water may flow into the producing drain and mix with the sought effluent. This leads to moving the production drain away from the interface as much as possible to avoid a water inflow.

A method for decreasing the intake, in a drain conveying a petroleum effluent, of another, undesirable fluid coming from an adjoining zone under the effect of the pressure gradient caused by the withdrawal is well-known through French patent FR 2,555,247. This is achieved by piercing through the production zone a first deflected drain and at least a second drain closer to the interface with the adjoining zone than the first drain. Part of the second drain may be on the interface or even in the adjoining zone. Both drains are then made to produce. The undesirable fluid is directly collected through the second drain when it is drilled in the adjoining zone. When the second drain is drilled in the production zone itself or near the interface, the undesirable fluid intake generated by the withdrawal performed in the first drain is mainly collected through the second drain. In all cases, the interface between the two fluids is stabilized. The inflow of undesirable fluid in the first drain is suppressed or highly decreased.

One technique used for assisting the production of petroleum effluents that are little mobile or much less mobile than the water which may be present in an adjoining zone essentially consists in injecting steam into the formation to increase the mobility of the effluents immobilized in the pores. Various methods utilizing this technique are described for example in U.S. Pat. Nos. 4,733,724; 4,718,489; 4,641,709; 4,607,699; 4,574,884; 4,344,485, etc.

Sweeping through the displacement fluid can for example be achieved between two drains laterally offset in relation to one another and substantially parallel. U. S. Pat. No. 4,574,884 for example describes a method comprising drilling two horizontal drains substantially in the same horizontal plane and laterally offset in relation to one another and substantially parallel. After establishing fluid pressure transmission or communication channels between the two drains, a fluid displacement is generated (by combustion) in the formation around the first drain in order to sweep the formation and the displaced effluents are collected through the other drain.

The lateral sweeping of a production zone by the displacement fluid is often difficult and little profitable because of the presence of a subjacent aquifer. It may sometimes happen that the displacement fluid quickly ends up in the aquifer fruitlessly. It may also happen that it displaces the oil from the formation towards the aquifer. This oil is then trapped in contact with water. Besides, withdrawing the swept oil through the production drain has the effect, as seen above, of deforming the interface through a coning effect and of driving the water out of the aquifer.

SUMMARY OF THE INVENTION

The method according to the invention allows to improve the efficiency of the recovery of effluents such as petroleum effluents through the lateral sweeping, by means of a displacement fluid, of an underground formation adjoining an aquifer under pressure. It comprises in combination:

creating (by drilling) through the formation to be stimulated a doublet comprising a first deflected drain crossing the formation and a second deflected drain laterally offset in relation to the first one;

piercing (by drilling) through the formation to be stimulated at least one complementary drain closer to the interface between the formation to be stimulated and said aquifer than the two drains of the stimulation doublet;

injecting a displacement fluid into the formation through one of the two drains of the doublet;

establishing a liquid circulation (by injection or withdrawal) by using the complementary drain which is closer to the interface than the two other drains; and withdrawing through the other drain of the stimulation doublet the effluents displaced in the formation under the action of the injected displacement fluid.

The drains of the first doublet are preferably substantially parallel, at least in the part of the stimulated formation.

According to one embodiment, the complementary drain is pierced closer to the first drain than to the second drain and establishment of liquid circulation is achieved and obtained in the formation by injecting a liquid through said drain.

According to a second embodiment, the complementary drain is pierced closer to the second drain than to the first drain and establishment of a water circulation is achieved in the complementary drain closer to the interface by withdrawing liquid through said drain.

The method may also comprise piercing at least a fourth drain laterally spaced apart in relation to the third complementary drain and forming together with it a second circulation doublet closer to the interface than the first stimulation doublet, injecting the liquid through the drain of the circulation doublet which is the closest to the drain of the first doublet used for injecting the displacement fluid, and withdrawing the liquid from the formation through the other drain of the second circulation doublet.

The displacement fluid injected into the formation for stimulating it may be a fluid comprising solvent products, a warm fluid such as steam, or a gas such as carbon dioxide $CO_2$.

This displacement fluid may be injected from the surface or in some cases be produced in situ.

The invention also relates to an arrangement for implementing the method which comprises a first doublet of drains and at least one complementary drain.

It will be seen in detail from the following description that establishing a water circulation by injection or withdrawal has the effect of:

diverting towards the withdrawing drain of the first doublet the effluents displaced by the displacement fluid which effluents would otherwise be easily trapped in the aquifer, and thereby increasing the amounts of effluents recovered; and avoiding a fruitless dispersion of the displacement fluid in the aquifer to the detriment of the formation to be stimulated, and consequently improving the energy efficiency of the stimulation.

BRIEF DESCRIPTION OF THE DRAWINGS

Other features and advantages of the method according to the invention will be clear from the following description of embodiments given by way of non-limitative examples, with reference to the accompanying drawings in which.

DESCRIPTION OF THE PREFERRED EMBODIMENTS

Figure 1:
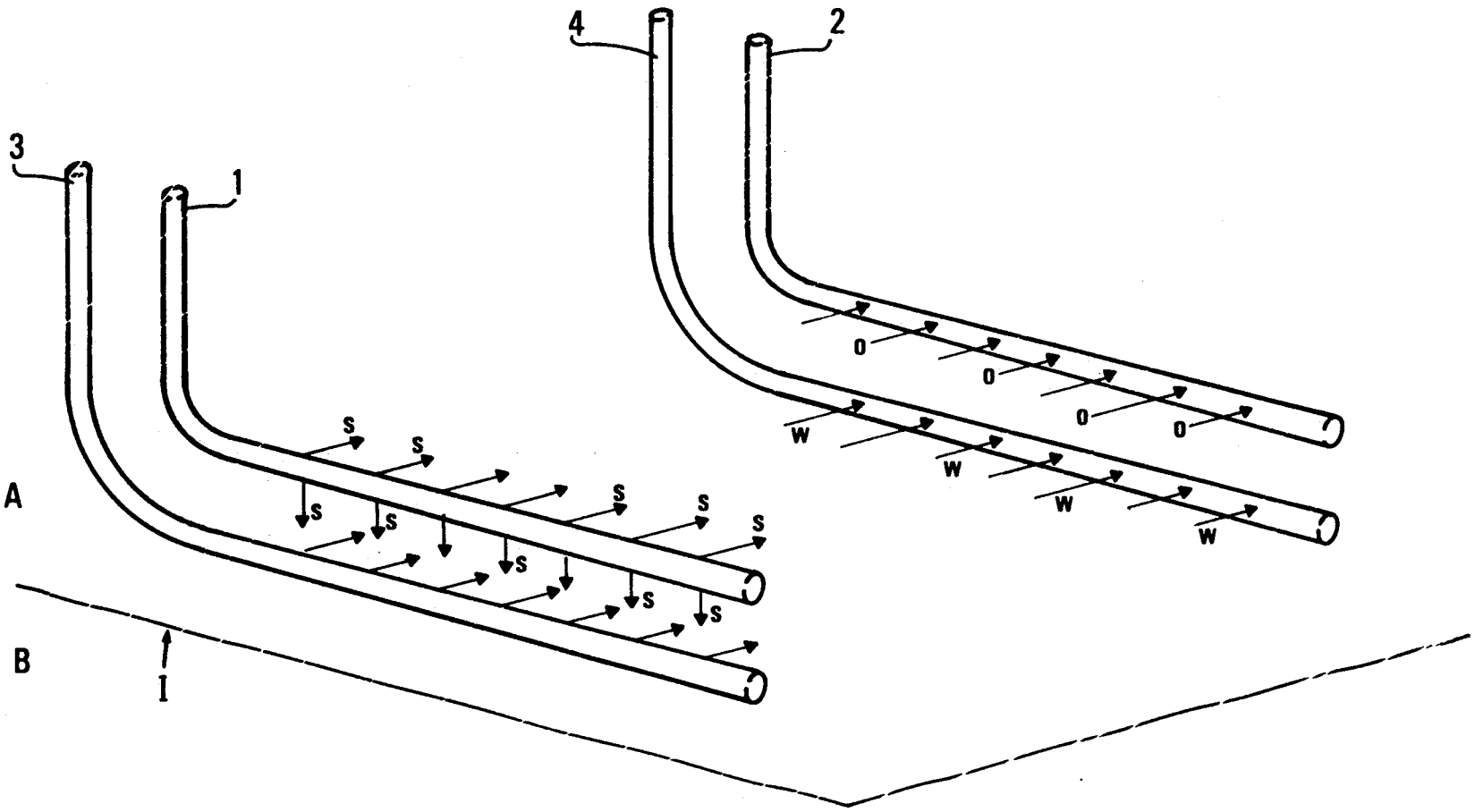
FIG. 1 shows a first embodiment of the method of the invention with two doublets of drains pierced through a formation to be stimulated surmounting an aquifer.

FIG. 1 diagrammatically shows a zone A of a formation containing petroleum effluents which lies above an aquifer B. I refers to the interface between formation A and aquifer B. Formation A contains effluents viscous enough to require a stimulation by injecting an appropriate fluid. A fluid of a well-known type, suitable for fluidizing the effluents, notably a warm fluid such as steam, solvents, a gas, etc, is used.

To that end, a first doublet of drains is pierced (by drilling) through the formation. This doublet, which is called a stimulation doublet, comprises a first drain 1 for injecting into the formation a displacement sweeping fluid such as a displacement fluid under pressure. This drain 1 is horizontal in the part thereof crossing through the zone brought in production or at least strongly deflected in relation to the vertical. The second drain 2 of the first doublet, laterally offset in relation to the first drain, is pierced towards the top of formation A. In the intervention zone, this second drain is substantially parallel to the first one. It is horizontal or strongly deflected like the first drain 1. This second drain 2 is bored in order to withdraw from the formation fluidized effluents displaced under the action of the displacement fluid which has laterally swept the formation volume between the two drains 1 and 2.

The method according to the invention comprises piercing or boring at least one complementary drain through the formation, in which a flow of liquid will be established, this drain being closer to the interface I between formation A and aquifer B than the drains of the first doublet.

According to the embodiment of FIG. 1, this circulation is established by piercing preferably through the formation a second doublet of complementary drains in the neighbourhood of interface I and laterally offset in relation to one another. This second doublet, which is called a circulation doublet, comprises a drain 3 located for example below the injection drain 1 of the first doublet and a drain 4 located for example below the withdrawing drain 2 of the first doublet. In the same way, drains 3 and 4 are substantially parallel in the intervention zone.

A displacement fluid likely to fluidize the little mobile effluents retained in the formation is injected therein through the first drain. This displacement fluid is, for example, a displacement fluid injected from a surface installation or possibly produced in the area surrounding drain 1 by combustion in situ. A volume of displacement fluid spreading laterally is thus formed. At the same time, injecting a liquid such as water for example is started through the third drain 3 and a depression is generated by pumping in the fourth drain 4. This depression has the effect of driving towards this drain water coming notably from the third drain 3 and which moved in the formation in the part close to interface I.

It can be observed that this water circulation established in the lower part of the formation has the effect of a lateral canalization. The displacement fluid zone spreads more easily towards the part of the formation crossed through by the withdrawing drains, with an increase in the size of the stimulated zone. The liquid circulation also prevents the displacement fluid from spreading towards the subjacent aquifer by carrying along towards this aquifer effluents which might otherwise be trapped therein. The canalization obtained through the water circulation further allows to avoid fruitless heat transfers towards the aquifer, in case warm fluids are injected.

The obtained results are convincing: the amount of effluents displaced by the displacement fluid and collected upon withdrawing is actually increased. Besides, in case the injected fluid is a warm fluid, the energy balance is improved because of the decrease in the useless heat transfers towards the aquifer.

The previous canalization effect can also be obtained with a single drain for the water circulation.

Figure 2:
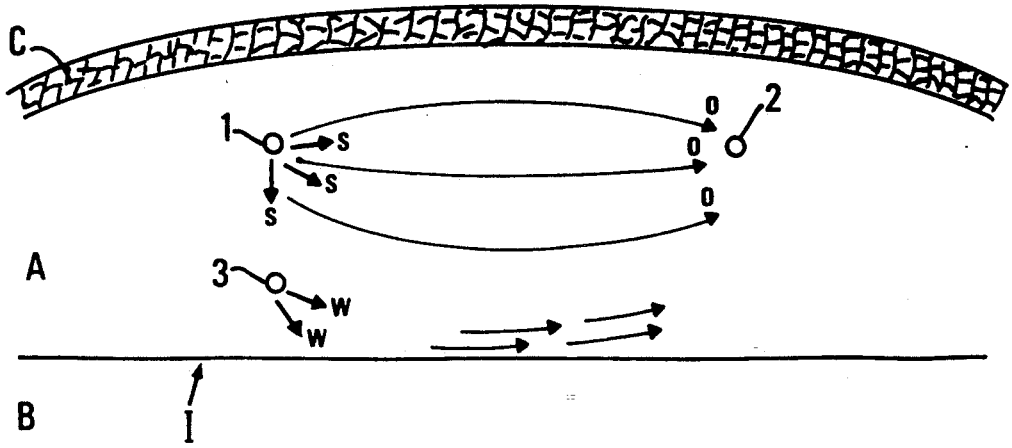
FIG. 2 shows a second embodiment of the method with a first stimulation doublet and a complementary drain for establishing a liquid circulation.

According to the embodiment of FIG. 2, a single circulation drain (drain 3) is pierced in the neigbourhood of the interface and a liquid is injected therein. The weight flow of the water injection through drain 3 is selected substantially equal to the weight flow of the injection of stimulation fluid through drain 1. With this single circulation drain 3, a significant increase in the amount of effluents displaced by the displacement fluid and withdrawn through the drain can again be observed.

Figure 3:
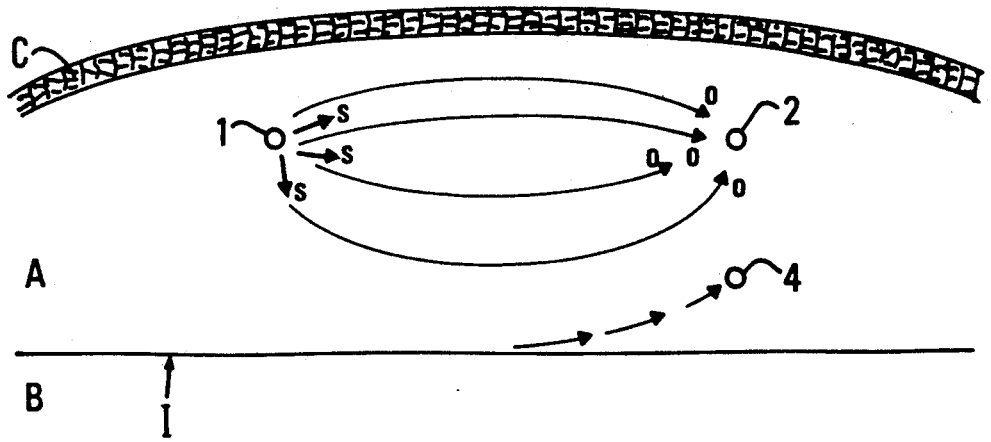
FIG. 3 shows a variant of the previous embodiment with another lay-out of the complementary drain for the liquid circulation.

According to the embodiment of FIG. 3, a single circulation drain (drain 4) is bored between the second drain 2 and aquifer B, and withdrawal is achieved through this drain 4. The generated depression deforms the interface between the formation and the aquifer. It can again be observed that the liquid circulation in the part of the formation below the drain has the effect of driving towards the drain more effluents displaced by the displacement fluid and that a significant increase in the amount of effluents which can be withdrawn from the formation is again obtained in this case.

In the above-mentioned embodiments, the drains have been defined according to either the injection or the withdrawal purpose thereof. It is obvious that drains can be used for one purpose at the time of the sweeping of a formation zone and fulfil the complementary purpose in case the sweeping of an adjoining zone is performed thereafter.

The method can be applied to another drain lay-out, including more than two drain doublets, or additional drains can be added to obtain a sweeping of the producing zone using a gravity effect for draining effluents, without departing from the scope of the invention.

We claim:

1. A method for stimulating the production of an effluent contained in an underground formation adjoining an aquifer under pressure by a lateral sweeping of the formation with an injected displacement fluid, comprising in combination:

piercing through the formation to be stimulated a stimulation doublet comprising a first deflected drain crossing the formation and a second deflected drain laterally offset in relation to the first drain;

piercing through the formation to be stimulated at least one complementary drain closer to an interface between the formation to be stimulated and said aquifer than the two drains of the stimulation doublet;

injecting a displacement fluid into the formation through the first drain of the stimulation doublet;

establishing a liquid circulation in the formation adjoining the interface by using said at least one complementary drain closer to the interface than the two drains of the stimulation doublet; and withdrawing through the second deflected drain of the stimulation doublet the effluents displaced in the formation under the action of the injected displacement fluid.

2. A method as claimed in claim 1, wherein a complementary drain is pierced closer to the first drain than to the second drain and establishment of a liquid circulation in the formation is obtained by injecting a liquid into the formation through this complementary drain.

3. A method as claimed in claim 1, wherein a complementary drain is pierced closer to the second drain than to the first drain and establishment of a liquid circulation in the formation is obtained by withdrawing the liquid from the formation through said complementary drain.

4. A method as claimed in any of the previous claims, further comprising piercing at least a complementary fourth drain laterally spaced apart in relation to a complementary third drain and forming together with it a second doublet closer to the interface than the drains of the first doublet, injecting a liquid through the third drain of the second doublet which is closest to the drain of the first doublet used for injecting the displacement fluid and withdrawing the liquid from the formation through the fourth drain of the second doublet.

5. A method as claimed in claim 1 wherein the displacement fluid injected into the formation is a warm fluid.

6. A method as claimed in claim 1, wherein the displacement fluid injected into the formation is a gas.

7. A method as claimed in claim 1, wherein the displacement fluid injected into the formation comprises solvent products.

8. A method as claimed in claim 1, wherein the fluid is injected into the formation from the surface.

9. A method as claimed in claim 1, wherein the displacement fluid injected into the formation is a warm fluid which is produced in situ.

10. A method as claimed in claim 1, wherein the two drains of the stimulation doublet are substantially parallel, at least in the part of the underground formation stimulated by lateral sweeping.

11. An arrangement for implementing the method as claimed in claim 1, comprising a first doublet of drains, at least one complementary drain closer to the interface between the formation and the adjoining aquifer than the drains of the first doublet, means for injecting a displacement fluid into the formation through a drain of the first doublet, first pumping means for withdrawing the effluents displaced by the displacement fluid towards the other drain of the first doublet and second pumping means for establishing a water circulation in each complementary drain.

* * * * *